US005551670A

United States Patent [19]

Heath et al.

[11] Patent Number: 5,551,670

[45] Date of Patent: Sep. 3, 1996

[54] HIGH INTENSITY INFRARED HEAT TREATING APPARATUS

[75] Inventors: James E. Heath, Fridley; Scott L. Angell, Blaine, both of Minn.

[73] Assignee: BGK Finishing Systems, Inc., Blaine, Minn.

[21] Appl. No.: 598,393

[22] Filed: Oct. 16, 1990

(Under 37 CFR 1.47)

[51] Int. Cl.[6] ..... C21D 11/00

[52] U.S. Cl. ..... 266/87; 266/103

[58] Field of Search ..... 266/172, 103, 266/252; 392/407, 411, 424; 219/411, 390, 405, 306, 354; 432/15

[56] References Cited

U.S. PATENT DOCUMENTS

| | | | |
|---|---|---|---|
| 3,204,085 | 8/1965 | Busby, Sr. | 219/346 |
| 3,404,874 | 10/1968 | Wynne | 266/103 |
| 4,241,292 | 12/1980 | Kreick | 219/541 |
| 4,437,834 | 3/1984 | Vogel | 432/15 |
| 4,454,472 | 9/1985 | Arai et al. | 219/411 |
| 4,533,820 | 8/1985 | Shimizu | 219/411 |
| 4,563,151 | 1/1986 | Vogel | 432/15 |
| 4,620,884 | 11/1986 | Heath | 266/103 |
| 4,738,615 | 4/1988 | Bailey et al. | 432/15 |
| 4,752,061 | 6/1988 | Dalton et al. | 266/252 |
| 4,800,252 | 1/1989 | Steixner | 219/306 |
| 4,818,849 | 4/1989 | Matlen | 219/354 |
| 4,820,906 | 4/1989 | Stultz | 219/405 |
| 4,885,484 | 12/1989 | Lavoie et al. | 219/390 |

FOREIGN PATENT DOCUMENTS

| | | |
|---|---|---|
| 0026032 | 4/1981 | European Pat. Off. . |
| 0113919 | 7/1984 | European Pat. Off. . |
| 0133847 | 3/1985 | European Pat. Off. . |
| 0372166 | 8/1989 | European Pat. Off. . |

*Primary Examiner*—Scott Kastler

*Attorney, Agent, or Firm*—Merchant, Gould, Smith, Edell, Welter & Schmidt

[57] ABSTRACT

An apparatus is disclosed for heat treating a product. The apparatus includes a plurality of lamp assemblies. Each of the assemblies has an infrared lamp disposed within a quartz conduit. The quartz conduit is formed of material which is generally transparent to infrared radiation. A cooling quartz is admitted into the lamp conduit. A frame is provided defining the heat treatment. The frame supports the lamp assemblies with the assemblies opposing the heat treatment area. Reflective refractory materials surrounds the lamps and the heat treatment area.

8 Claims, 4 Drawing Sheets

HIGH INTENSITY INFRARED HEAT TREATING APPARATUS

I. BACKGROUND OF THE INVENTION

1. Field of the Invention

This invention pertains to apparatus for heat treating a product. More particularly, this invention pertains to a heat treating apparatus which includes infrared lamp assemblies and reflective ceramic cooperating to form a heat treating oven.

2. Description of the Prior Art

The use of infrared radiation to heat treat a continuous run of a product is well known. An example of such is shown in my prior U.S. Pat. No. 4,229,236 issued Oct. 21, 1980. In that patent, a pair of spaced apart parallel banks of high intensity infrared radiation lamps are disposed on opposite sides of a heat treatment area. A continuous sheet of a product is passed through the treatment area. Ceramic reflectors are provided on exterior sides of the banks of lamps. The reflectors are provided with openings through which air flow can be passed to cool the lamps.

In utilizing infrared lamps for heat treating purposes, a significant amount of equipment down time can be attributed to the need to replace lamps which burn out from time to time. It is desirable to increase the life of the lamps while permitting the highest possible lamp intensity during operation. Also, with apparatus such as that shown in my prior U.S. Pat. No. 4,229,236, the lamp is directly heating the product. Direct heat treatment is generally undesirable when heat treating a continuous product flow since the direct heat may miss the target or prevent localized hot spots. It is more desirable to provide a oven-like environment of uniform heat intensity along a heat treatment area. Also, it is desireable from time to time to provide such an apparatus while permitting atmosphere control within the heat treatment area.

II. SUMMARY OF THE INVENTION

According to a preferred embodiment of the present invention, an apparatus is provided for heat treating a product. The apparatus includes a plurality of lamp assemblies. Each of the assemblies has an infrared lamp disposed within a conduit formed of material generally transparent to infrared radiation. A cooling gas is admitted into the interior of the conduit to cool the lamp during operation. A frame is provided for providing a heat treatment area. The frame supports the plurality of lamp assemblies with the assemblies opposing the heat treatment area. Reflective refractory is provided surrounding the heat treatment area and the lamps.

III. BRIEF DESCRIPTION OF THE DRAWINGS

IV. DESCRIPTION OF THE PREFERRED EMBODIMENT

Figure 1:
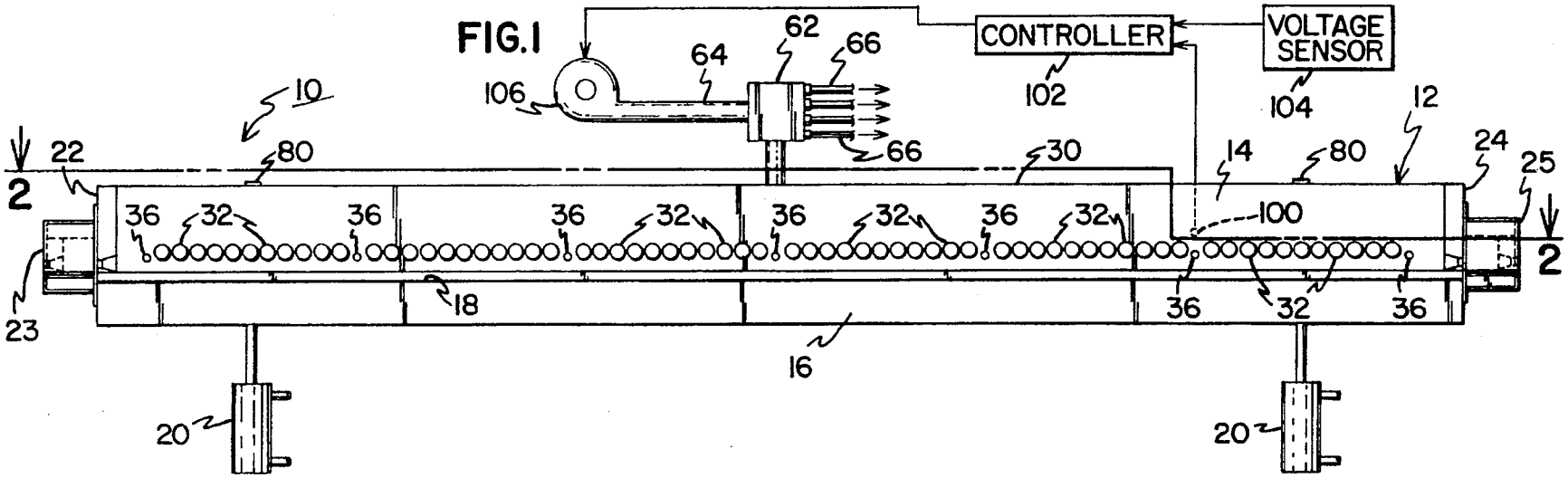
FIG. 1 is a side elevation view of a heat treatment apparatus according to the present invention.

Referring now to the several drawing figures in which identical elements are numbered identically throughout, a description of the preferred embodiment of the present invention will now be provided.

A heat treatment apparatus 10 according to the present invention is shown having a frame 12 which includes an upper frame half 14 and a lower frame half 16. The frame halves 14,16 are joined at a parting line 18. Upper frame half 14 is secured from movement through any suitable means (not shown) such as a support structure carried on a factory floor. The lower frame half 16 is movable toward and away from the upper frame half 14. Pneumatic cylinders 20 are provided for controlling movement of lower frame half 16. For purposes of clarity in the illustrations, the support structure for the frame halves 14 and 16 is not shown. Also, for the purposes of clarity of the illustration, FIG. 1 did not show bus bars, infrared lamp assemblies or cooling air manifolds on the upper frame half 14. These elements are shown in other figures and are described elsewhere in this specification.

Frame half 14 includes end walls 22,24 and side walls 26,28 and top wall 30. The walls of the frame 12 cooperate to define a heat treatment area 40 extending the length of the apparatus 10 from end wall 22 to end wall 24. End caps 23,25 are provided on end walls 22,24.

Figure 2:
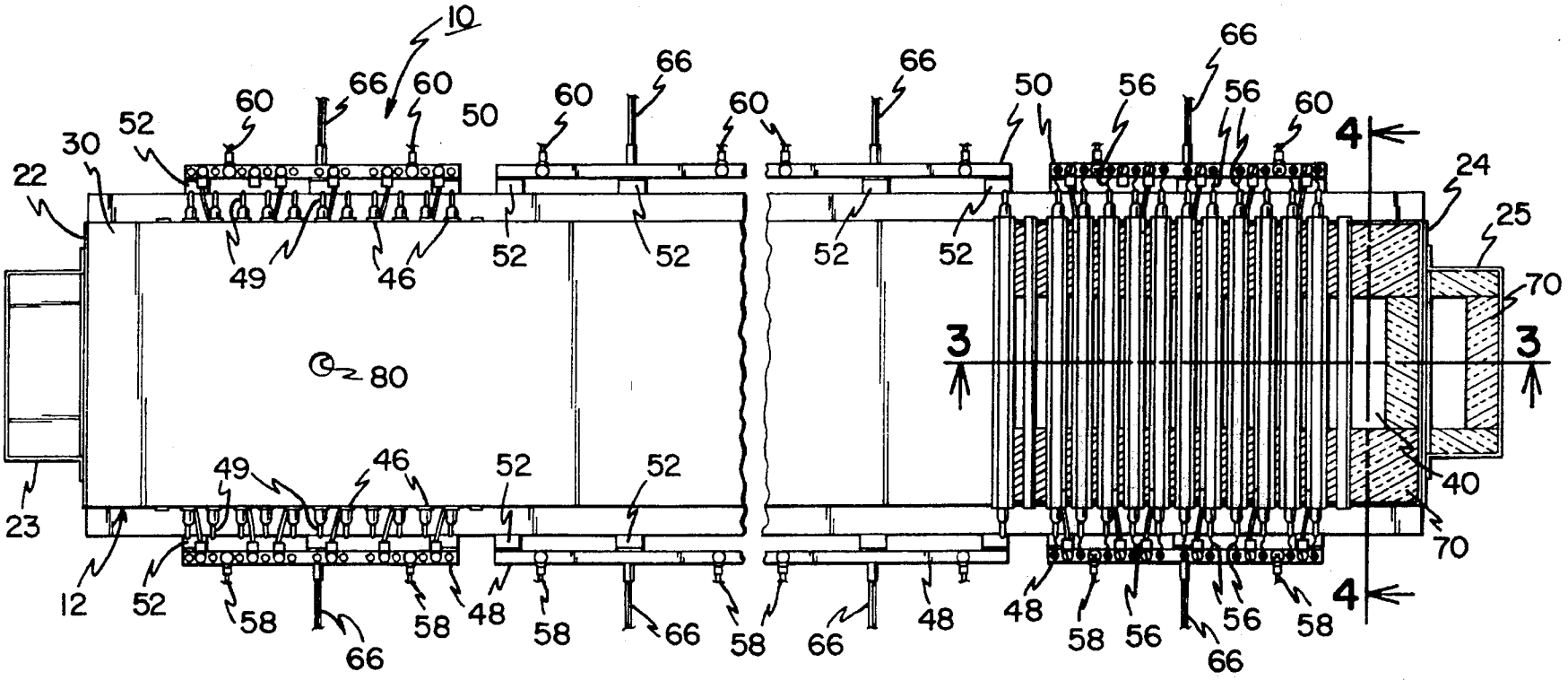
FIG. 2 is a view taken along line 2—2 of FIG. 1.

As shown in FIG. 1, the side walls 26,28 are provided with a plurality of holes 32 sized to receive infrared lamp assemblies 34 (see FIG. 2). Interspersed between the holes 32 are smaller diameter holes 36 sized to receive protection rods 38.

Figure 5:
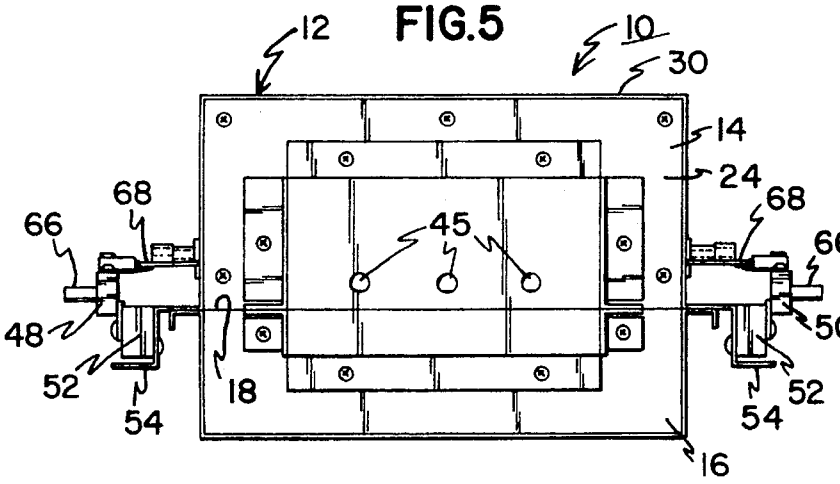
FIG. 5 is an end view, taken in elevation, of the apparatus of FIG. 1.
Figure 3:
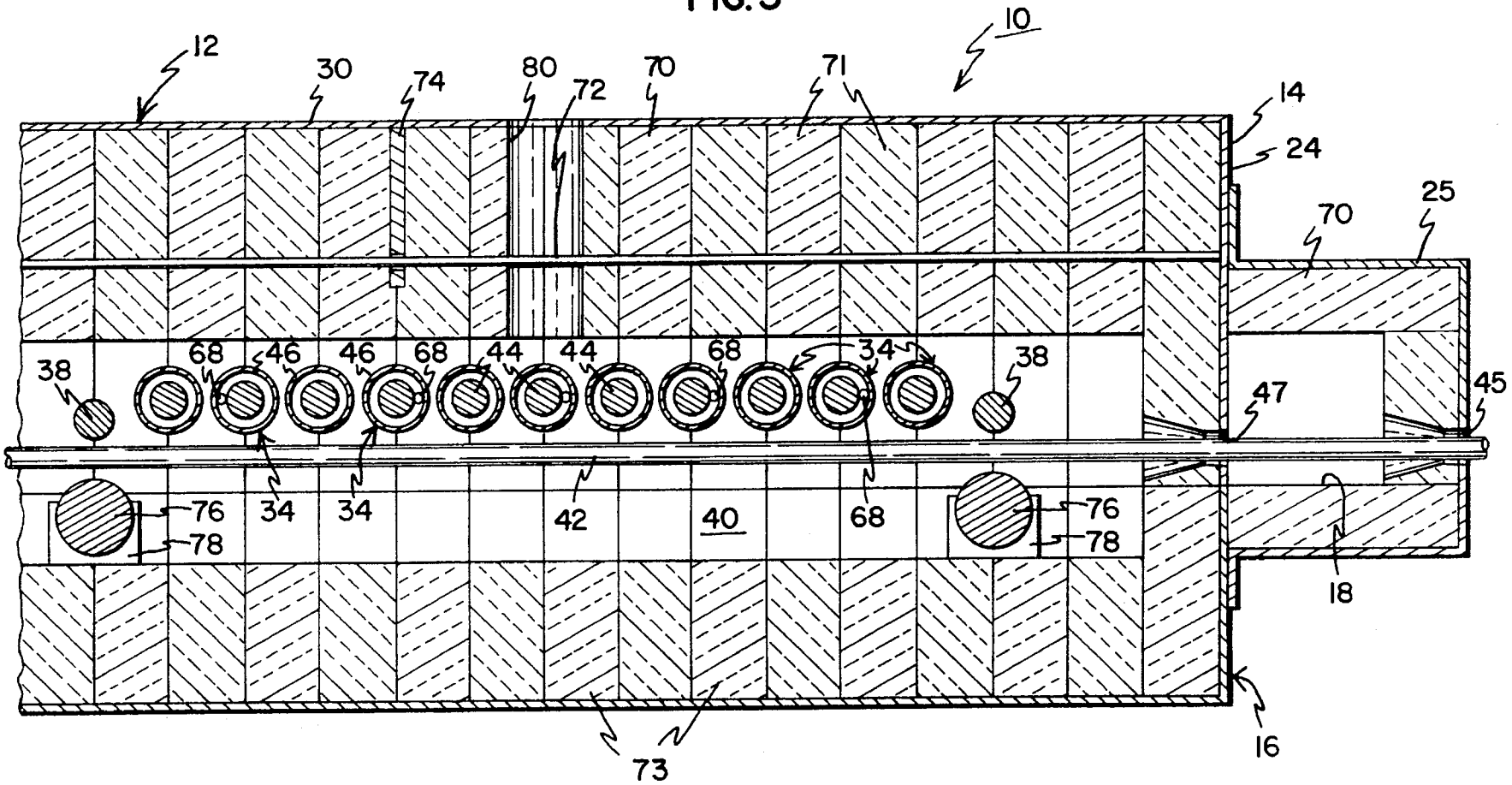
FIG. 3 is a view taken along line 3—3 of FIG. 2.
Figure 7:
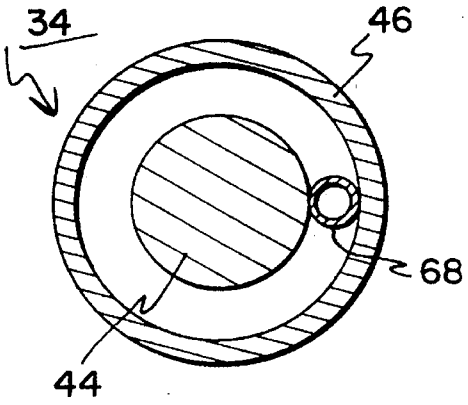
FIG. 7 is an enlarged cross-sectional view of a lamp assembly for use with the present invention.

In the preferred embodiment, the present invention is intended for use in heat treating a product in the form of a continuous or the like wire 42 constantly moving through the apparatus. (While the apparatus 10 is shown heat treating a wire 42, it will be appreciated it can be utilized for heat treating a wide variety of products). Preferably, three wires or more can be simultaneously heat treated by forming holes in end walls 22,24 and end caps 23,25 (such as holes 45 shown in end cap 25, see FIG. 5 and hole 47 shown in end wall 24, see FIG. 3).

As previously mentioned, a plurality of lamp assemblies 34 are provided extending through holes 32 from side wall 26 through side wall 28. Each of the assemblies 34 includes a high intensity infrared lamp 44. Each of the assemblies 34 further include an infrared transparent quartz tube 46 which acts as a conduit to receive the lamps 44. Means (not shown but preferably in the form of commercially available retaining clips) are provided for concentrically positioning the infrared lamps 44 within each of the quartz tubes 46. Assemblies 34 are disposed within the heat treatment area 40 with the quartz tubes extending through side walls 26,28. The infrared lamps 44 have a length selected for electrical lead ends 49 of the lamps 44 to extend slightly beyond the terminal ends of the quartz tubes 46 (see FIG. 2).

Figure 4:
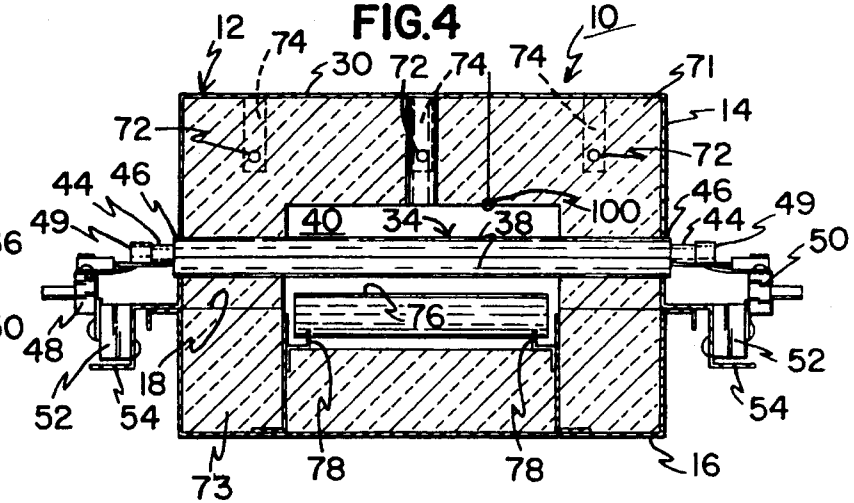
FIG. 4 is a view taken along line 4—4 of FIG. 2.

A plurality of charged and grounded bus bars 48,50, respectively, are provided mounted on side walls 26,28 respectively. Each of bars 48,50 are identical. The bars 48,50 are hollow and are formed from electrically conductive material. The bars 48,50 are mounted to side walls 26,28 by dielectric spacers 52 carried on mounting brackets 54 (shown best if FIGS. 4 and 5.

The exposed electrical lead ends 49 of the infrared lamps 44 are connected to bus bars 48,50 by electrical conductors 56 (see FIG. 2). (In FIG. 2, for purposes of clarity, not all of lamps 44 are shown connected to bus bars 48,50.) Main electrical leads 58,60 connect bus bars 48,50 to a potential or a ground, respectively, (not shown) to complete a circuit across the lamps.

As previously indicated, each of bus bars 48,50 is hollow. A main distribution manifold 62 is carried on upper frame half 14 and connected via conduit 64 to a source (not shown) of pressurized air. A plurality of distribution conduits 66 connect manifold 62 with the interior of each of hollow bus bars 48,50 to distribute pressurized air to the interior of the bus bars 48,50. A plurality of copper tubes 68 are provided connecting the interior of bus bars 48,50 in air flow communication with the interior of conduits 46. As shown in the Figures, tubes 68 from bus bars 48,50 extend with alternate adjacent conduits 46. Accordingly, pressurized air is admitted from manifold 62 into each of lamp assemblies 34.

As shown in FIG. 2, the lamp assemblies 34 are disposed in side-by-side relation generally transverse to the direction of travel of the product wire 42. Extending below the plane of the lamp assemblies 34 are the ceramic protection spacers 38. The spacers 38 keep the product wire 42 in spaced relation from the lamp assemblies 34 to prevent damage to quartz tubes 46.

Figure 6:
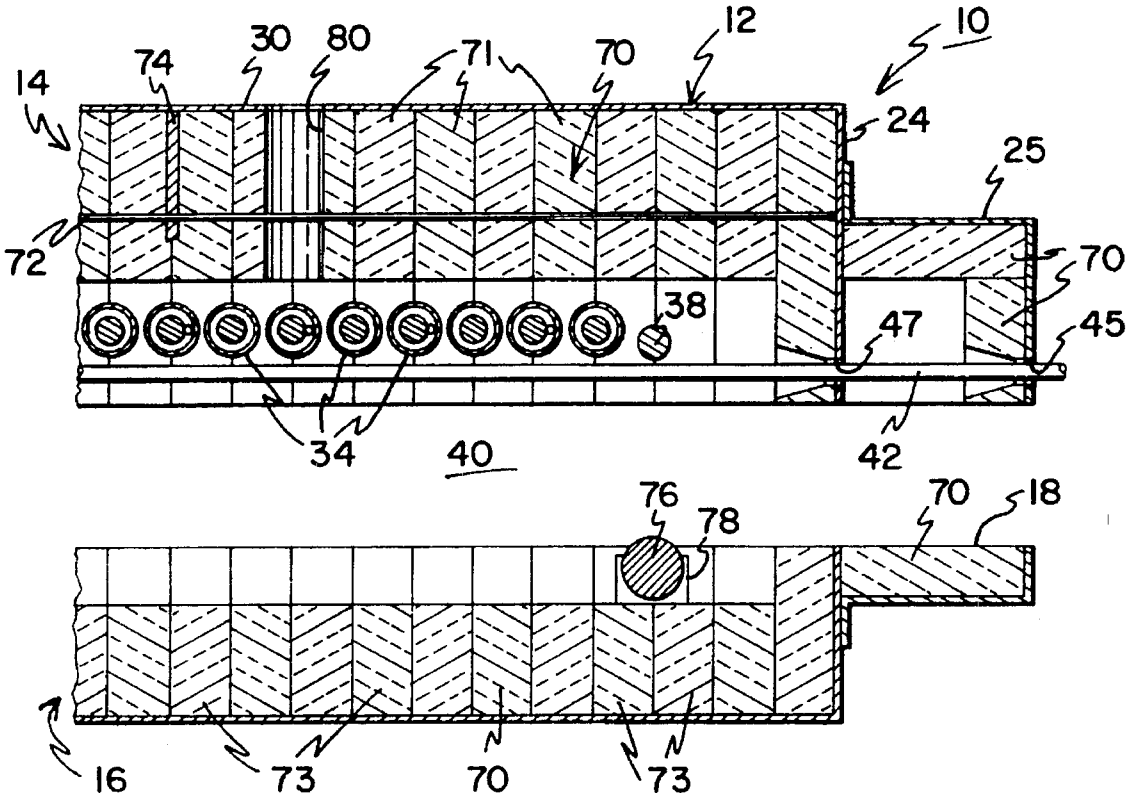
FIG. 6 is the view of FIG. 3 with upper and lower halves of the frame shown separated.

Reflective refractory material in the form of reflective ceramic 70 is provided surrounding lamp assemblies 34 and surrounding heat treatment area 40. Best shown in FIG. 3 and 6, the refractory material 70 are thin sheets 71,73 of moldable refractive ceramic fiber (preferably a 3,000° F. moldable ceramic fiber). The thickness of the ceramic fiber sheets are shown exaggerated in FIGS. 3 and 6 for the purposes of illustration.

Sheets 71 are carried by upper frame half 14 and sheets 73 are carried by lower frame half 16. To retain the sheets 71 in upper frame half 14, a tie rod 72 is provided extending the length of upper frame half 14. The tie rod 72 extends through each of the sheets of ceramic 71. The tie rod 72 is supported from top wall 30 by metallic clips 74.

Ceramic spacers 76 are carried on mounting clips 78 provided in lower frame half 16. The spacers 78 are disposed with the product wire 42 positioned between spacers 38 and 76. The spacers 76 prevent product 42 from sagging and contacting the lower ceramic sheets 73.

Gas admission ports 80 are provided extending from upper wall 30 and through the insulation 71 into the heat treatment area 40. The ports 80 may be connected to any source (not shown) of desired control gas. For example, ports 80 may be connected to a source of pressurized nitrogen as an inert gas or any reducing gas if process applications would so require.

With the apparatus thus described, a product 42 may be continuously fed through the apparatus 10 from end wall 24 to end wall 22. The infrared lamps 44 are energized by energizing bus bars 48,50. In a preferred example, the lamps heat to about 4,000° F. to heat the area 40 to about 2,000° F. The lamps 44 cooperate with the reflective ceramic 70 to dissipate the energy within the heat treatment area 40. Accordingly, the temperature within area 40 is constant throughout the length of the heat treatment area 40. This results in an oven-like effect within the interior of the apparatus 10. While the apparatus is being used to heat treat a product wire 42 or the like, inert gas, such as nitrogen, is admitted through ports 80 into treatment area 40 at a pressure greater than ambient air pressure. This insures the presence of an inert atmosphere within area 40. Throughout the process, coolant air (i.e., pressurized ambient air) is passed from main manifold 62 into each of quartz conduits 46 through tubes 68. The coolant air cools the lamps to enhance their useful life.

As previously indicated, a cooling gas is passed through the lamp assemblies 34. In operation, the temperature of the apparatus can be quite high. For example, the temperature in the heat treatment area 40 will preferably be about 1,500° F. At temperatures in excess of 1,500° F., the quartz tubes 46 may deteriorate. For example, from 1,500° to 1,800° F., quartz softens and sags.

The air passing through the quartz tubes 46, cools the quartz tube 46 to prevent sagging. However, the air flow can adversely effect the efficiency of the infrared lamps 44. Accordingly, air flow through the quartz tubes 46 must be balanced to provide sufficient cooling to prevent the quartz tubes 46 from sagging while minimizing the adverse impact on the efficiency of the lamps 44.

To achieve the desired balancing, air flow through quartz tubes 46 is only provided when the temperature within the heat treatment area 40 exceeds a predetermined minimum temperature. (In a preferred embodiment, the predetermined minimum temperature is 1,500° F.).

The amount of air flow through the tubes 46 is selected to balance the thermal energy on the tubes 46. Namely, the air mass in heat treatment area 40 draws thermal energy from the tubes 46. If the thermal energy drawn from the tubes 46 is insufficient to keep the temperature of the tubes 46 below the predetermined temperature, air flow is passed through the tubes 46 at a rate selected to draw energy away from the tubes 46. The amount of air flow is a function of the length of the tubes 46, the voltage across the lamps 44 and the ambient temperature (i.e., the temperature of the area 40 in the immediate vicinity of the tubes 46). The actual amount of air flow is empirically derived for a given apparatus 10 and will vary with the operating process in which it is used.

To achieve the balancing, the thermocouple 100 (schematically shown only in FIG. 1 and FIG. 4) is provided for sensing the temperature within chamber 40. Thermocouple 100 provides a signal to a controller 102. The controller 102 also receives an input from a voltage sensor 104 which senses a voltage across the lamps 44. Comparing the voltage on the lamps 44 and the temperature within chamber 40, the controller 102 operates a blower 106 to force coolant gas through the quartz tubes 46 when the temperature within the heat treatment area 40 exceeds the predetermined minimum temperature. The air flow through the quartz tubes 46 selected as an increasing function of the voltage across the lamps 44 and to be increasing with the temperature measured by thermocouple 100. The increasing function is selected for the air flow to be the minimum air flow necessary to prevent deterioration of the quartz tubes 46.

From the foregoing details of the description of the present invention, it has been shown how the invention had been attained in a preferred manner. However, modifications and equivalents of the disclosed concepts such as those which readily occur to one skilled in the art, are intended to be included within the scope of this invention.

What is claimed is:

1. An apparatus for heat treating a product being moved continuously along a product length, said apparatus comprising;

a frame having a plurality of walls defining a product heat treatment area sized to receive a continuous moving feed of said product as said product moves along said product length, said plurality of walls including end walls have means to pass said feed from an exterior of said frame and into said heat treatment area with said product extending between said end walls;

a plurality of lamp assemblies each having an infrared lamp, aa lamp conduit of material generally transparent to infrared radiation with said lamp disposed within said conduit and cooling fluid admission means for admitting a cooling fluid to said conduit;

said lamp assemblies carried on said frame with said lamp assemblies opposing said heat treatment area;

reflective refractory means surrounding said heat treatment area.

2. An apparatus according to claim 1 comprising spacer means for spacing said product from said assemblies.

3. An apparatus according to claim 1 wherein said assemblies are disposed in generally side-by-side relation opposing said area and said reflective refractory means includes a first portion disposed on a side of said assemblies opposite said area and a second portion disposed on a side of said area opposite said assemblies.

4. An apparatus according to claim 3 wherein said frame includes an half and a second half, said assemblies and said first refractory portion secured to said first half, said second refractory portion secured to said second half, means for separating said first half from said second half to expose said heat treatment area.

5. An apparatus according to claim 1 comprising atmosphere control means for admitting a control gas to said heat treatment area.

6. An apparatus according to claim 4 wherein said first refractory portion includes a plurality of sheets of reflective ceramic disposed in face-to-space relation.

7. An apparatus according to claim 1 comprising a plurality of bus bars supported on said frame and including at least a charged bar and a grounded bar with means for connecting each of said lamps to a charged and a grounded bar.

8. An apparatus according to claim 1 comprising a cooling gas manifold carried on said frame with a plurality of cooling gas conduits connected to said manifold and extending therefrom to each of said lamp conduits.

* * * * *